US007335149B1

(12) United States Patent
Hanson

(10) Patent No.: US 7,335,149 B1
(45) Date of Patent: Feb. 26, 2008

(54) SQUARE BOTTOM SEALABLE BAG FORMING MACHINE

(76) Inventor: Violet Hanson, P.O. Box 68, Old Bethpage, NY (US) 11804

( * ) Notice: Subject to any disclaimer, the term of this patent is extended or adjusted under 35 U.S.C. 154(b) by 0 days.

(21) Appl. No.: 11/480,603

(22) Filed: Jul. 3, 2006

(51) Int. Cl.
*B31B 1/28* (2006.01)

(52) U.S. Cl. ..... 493/252; 493/194; 493/245

(58) Field of Classification Search ..... 493/194, 493/196, 244, 245, 250, 252, 253
See application file for complete search history.

(56) References Cited

U.S. PATENT DOCUMENTS 3,812,644 A * 5/1974 Kamikawa et al. ..... 493/196
3,988,970 A * 11/1976 Hanson et al. ..... 493/252
4,230,030 A * 10/1980 Hanson et al. ..... 493/194
4,892,511 A * 1/1990 Luciano et al. ..... 493/194
4,929,224 A * 5/1990 Hanson et al. ..... 493/194
6,056,681 A * 5/2000 Ross ..... 493/228

* cited by examiner

*Primary Examiner*—Louis Huynh
(74) *Attorney, Agent, or Firm*—Bernard S. Hoffman

(57) ABSTRACT

A method and apparatus for the automatic manufacture of flat bottom bags from a substantially continuous supply of a sealable material whereby the material is formed as a bag having a reinforced sealed flat bottom formed by an interior bag forming assembly that is cooperable with a relatively movable bottom platform with sealers and a movable folder assembly that folds the bottom of the bag and removes it from the bag former assembly after a length of the bag is severed from the remainder of the material.

5 Claims, 18 Drawing Sheets

SQUARE BOTTOM SEALABLE BAG FORMING MACHINE

RELATED APPLICATION

This application is an improvement of U.S. Pat. No. 4,230,030, U.S. Pat. No. 4,892,511, U.S. Pat. No. 4,929,224, and U.S. Provisional Patent Application No. 60/715,451.

BACKGROUND OF THE INVENTION

The present invention relates to a method and apparatus for the high speed manufacture of folded reinforced flat bottom bags of the kind disclosed in U.S. Pat. No. 3,970,241.

SUMMARY OF THE INVENTION

In U.S. Pat. No. 4,230,030, U.S. Pat. No. 4,929,224, and U.S. Pat. No. 4,892,511 and U.S. Provisional Patent Application No. 60/715,451, there is disclosed an apparatus and method for the manufacture of the reinforced flat bottom bag. The present invention is an improvement upon such prior disclosed method and apparatus in that it teaches a method and apparatus by which the same kind of bags may be manufactured in rapid production manner inexpensively and finished in a folded condition with a more precise arrangement of constructural details that enable the manufacture of bags that are stronger than heretofore made and more attractive in appearance.

In the manufacture of the reinforced flat bottom bags, the bottom of the bag is creased and flattened with greater precision and sharpness to produce folds and seals of greater strength than capable of being made heretofore. The present invention is an improvement upon such prior patented disclosures in that it teaches for the first time, a method and apparatus that uses a forming assembly that shapes the flat bottom bag over substantially its whole planar extent by cooperating with bottom platform containing seals and a folder assembly that clamps the bag bottom between them. The cooperation between the former assembly, the bottom platform assembly and the folder assembly produces reinforcing seals of greater strength and extent and further serves to flatten the bottom of the bag into a stronger and more attractive appearance.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein:

DETAILED DESCRIPTION OF THE PREFERRED EMBODIMENT

Figure 1:
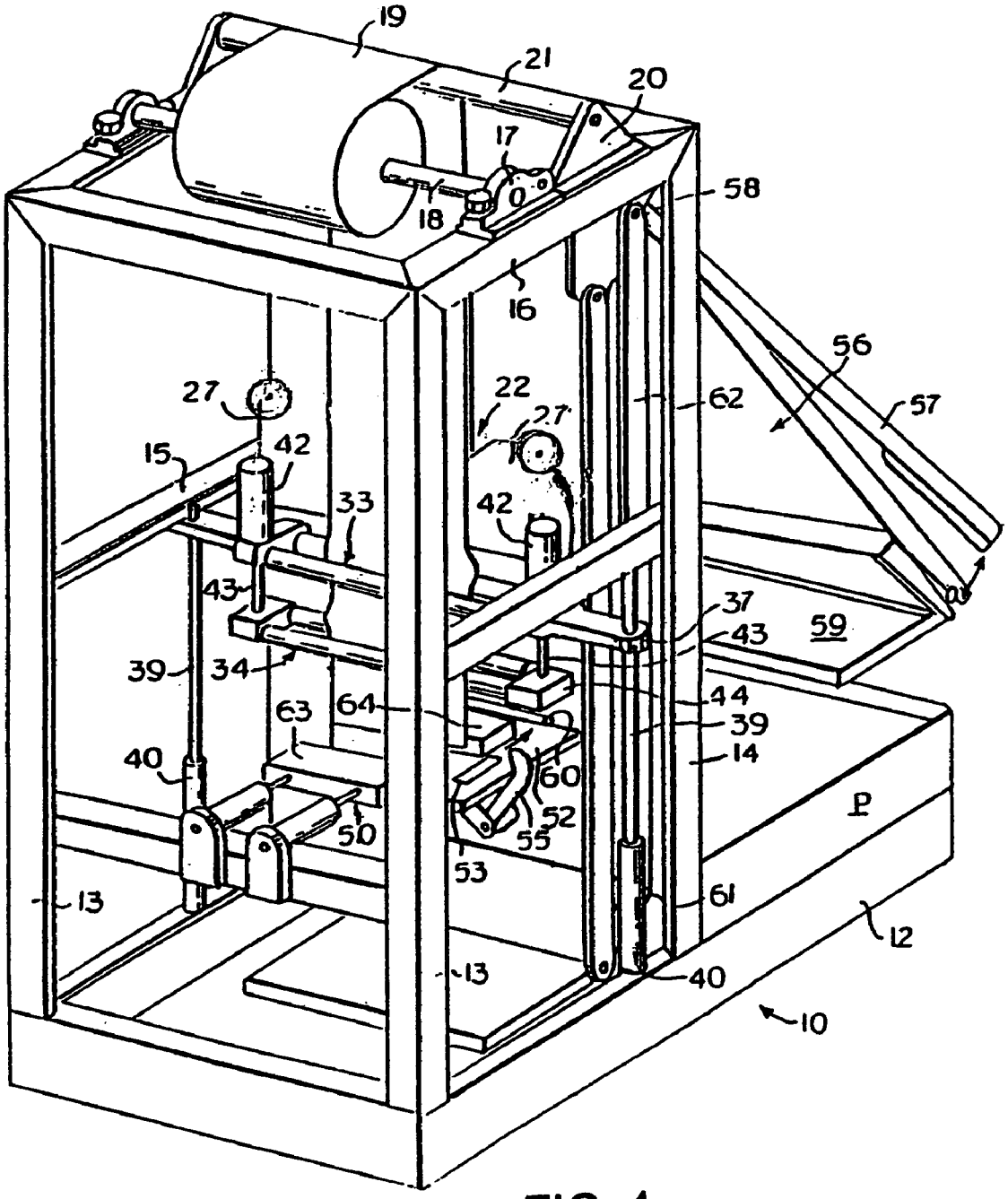
FIG. 1 is a perspective view of a machine for manufacturing folded flat bottom bags constructed according to the present invention.

Referring to the drawings and more particularly to FIG. 1, the apparatus there shown is generally identified by the numeral 10. It depicts a machine making and folding reinforced flat bottom bags, such as bags of the kind substantially as disclosed in U.S. Pat. No. 3,970,241. The apparatus or machine 10 for making and folding flat bottom bags requires a relatively small floor area because it is disposed generally vertically, extending upwardly from a base 12. The frame of the apparatus 10 includes a pair of front corner posts 13, corner posts 14, intermediate crossbars 15, and header beams 16.

Figure 2:
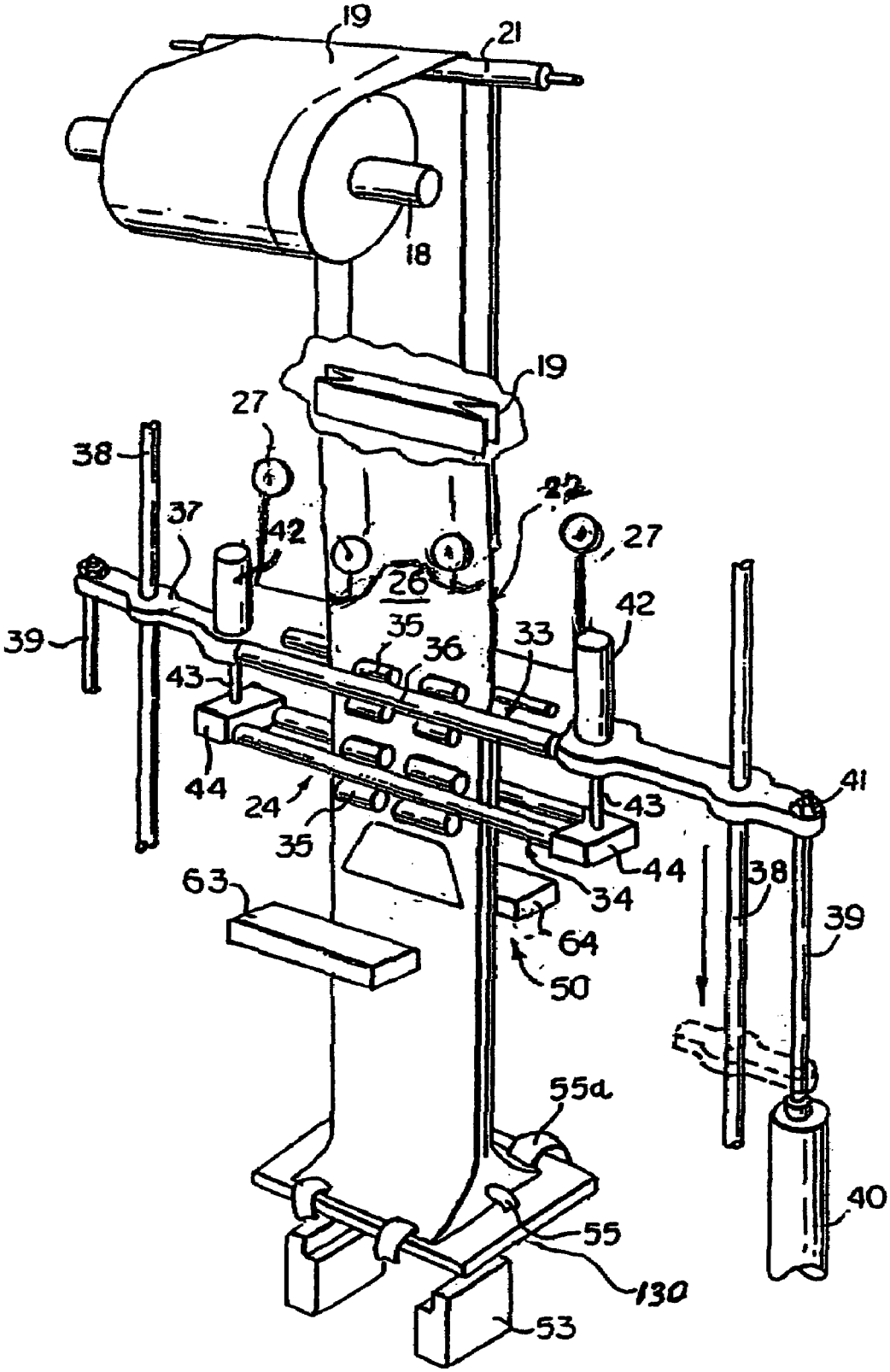
FIG. 2 is an exploded elevational and schematic view of the machine of FIG. 1.

Integral with the header beam 16 are a pair of pillow blocks 17 providing a journal for a rod 18 on which is a freely rotatably held supply roll of bag material 19 from which the flat bottom bags are to be formed. The supply roll of bag material 19 is substantially continuous in length and may be supplied in the form of a closed sleeve bag material to supply the same with flat faces and inwardly gussetted sides as seen in FIG. 2. Hence, it is possible to utilize a supply of bag material 19 that has a sleeve shape and that may or may not be pre-gussetted to eliminate the need to form such gussets at a later time in the present bag forming machine 10. The supply roll of bag material 19 may be of a heat sealable material.

Although it is not necessary that the sides or faces of the machine or apparatus 10 need be denominated as such, it is convenient for purposes of description that the space between the front posts 13 be denominated as the front and that the space between the rear posts 14 be referred to as the rear, while the front to rear spaces between posts 13 and 14 on each side be referred to as the sides left and right, respectively as seen in FIG. 1.

Mounted also, on the header beams 16, is a second pair of pillow blocks 20 in which journalled an idler roll rod 21, Preferably, the roller rod 21 is located slightly to the rear of the center line between the front and rear posts 13 and 14 respectively, so that the bag material 19 can roll therein and depend vertically therefrom. In this manner, the bag material 19 be made to freely pass sleeve-like over a bag forming assembly generally depicted by 22, wherein, in a cyclic and continuous manner, the material is pulled down, its leading section formed into a flat bottomed bag, sealed, cut and removed.

The bag forming assembly 22 as seen more fully in FIGS. 3, 3*a*, 3*b*, 3*c*, 3*d*, 3*e*, 3*f* comprises an upper mandrel, generally depicted by the numeral 23 adapted to guide and at the same time pre-open and shape the tubular supply of bag material 19, and a lower mandrel generally depicted by the number 24 which is caused to move between a raised inoperative position and a lower operative position in which the bottom of the bag is formed. The upper and lower mandrel sections are mounted on opposite sides of a central post 25, the upper mandrel section 23 being non-movable, while the lower mandrel section 24 is raiseable and lowerable as will be seen hereinafter. To insure additional guidance for the material and mandrel, right and left hand guide plates 27 are provided.

Figure 3:
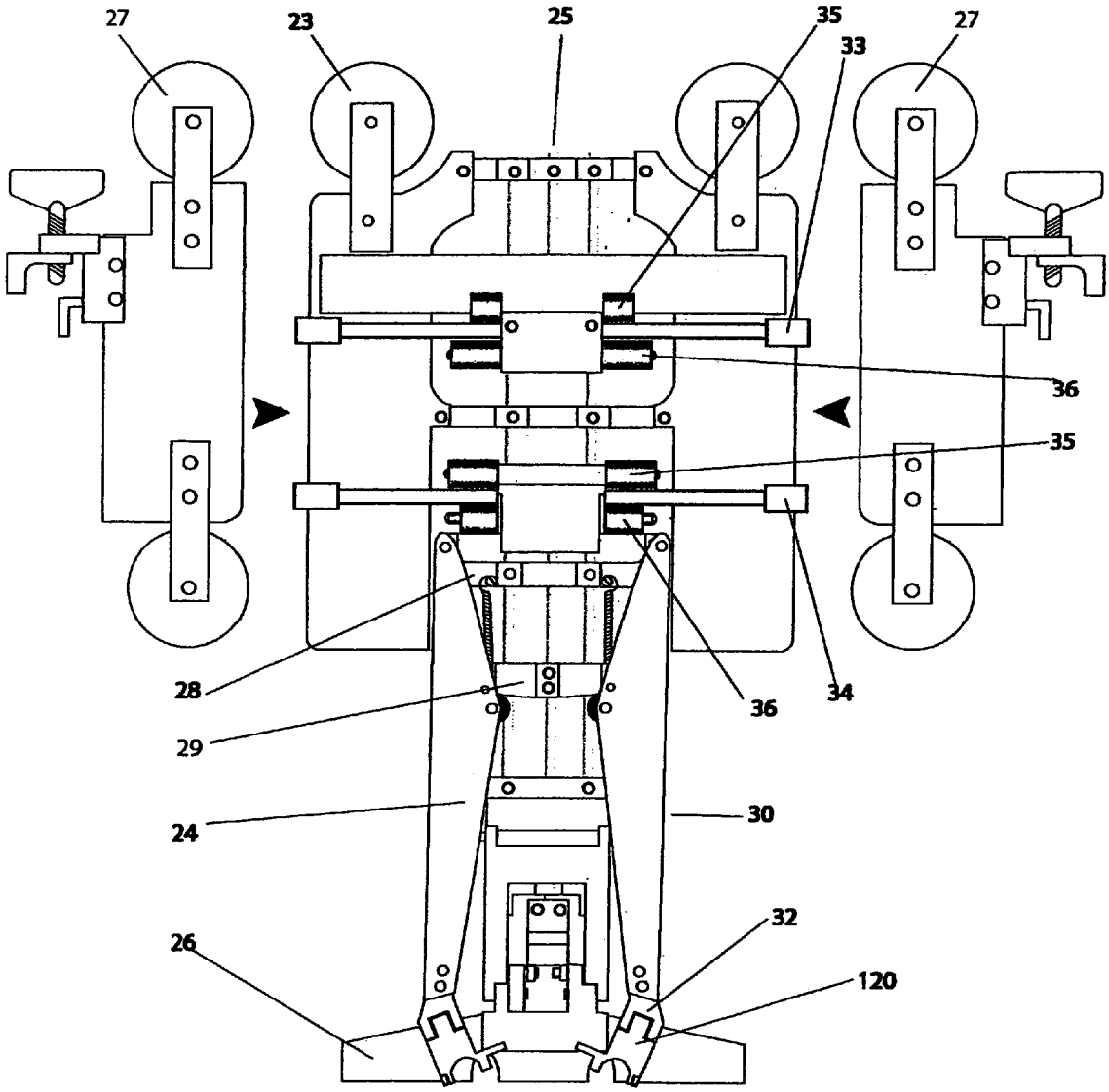
FIGS. 3, 3*a*. 3*b*, 3*c*, 3*d*, 3*e*, 3*f* are schematic views of the new mandrel for forming the bag as used in the present invention.

The upper mandrel section 23 as seen in FIGS. 2 and 3 include a pair of flat plates, hinged to the center post 25, generally parallel to the central plane of the vertically depending bag material 19. The longer front and back flat plates 26, and side portions 120 have cutout sections to allow the sealers mounted in the bottom platform to incorporate into the bag itself and seal the bag at these sections. The plates 26 are slightly sprung outward along their lower edges to cause the material to correspondingly spread out. Mounted in the plane of the vertically depending bag material 19 to either side of the material are a pair of gusset mandrel side plates 27 adapted to enter into the gussets of the bag and thus stabilize the bag material as the flat plates 26 spring the material outward.

The lower mandrel section comprises a sleeve 28 slidably mounted over a central post 25. Fixed on the sleeve 28 is a collar 29 against which a pair of lateral extending arms 30 hinged at their upper end 31 movably slide. At the lowered end of each of the arms 30 there is a pivotably mounted rectangular plate 32. As the collar 29 is caused to be raised or lowered relative to the center post 25 by movement, the arms 30 cause the plates 32 to move between a vertical inoperative position shown in dotted lines, the horizontal operative position shown in full lines and extending perpendicular to the plane of the drawing paper FIG. 3*a* by which it fully stretches the bag outward transverse to its width to form the partially completed flat bottom.

Figure 3C:
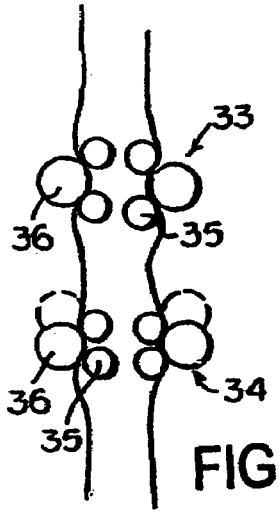
Figure 3B:
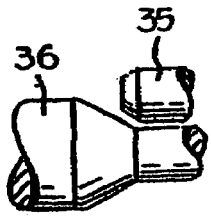
Figure 3D:
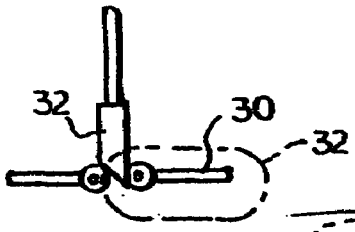
Figure 3A:
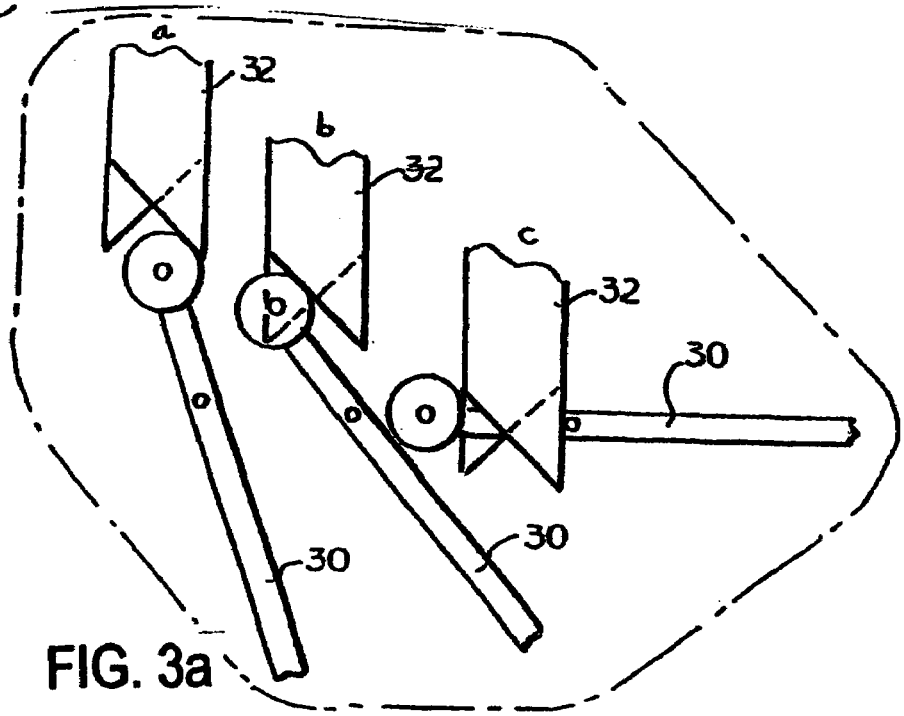
Figure 3E:
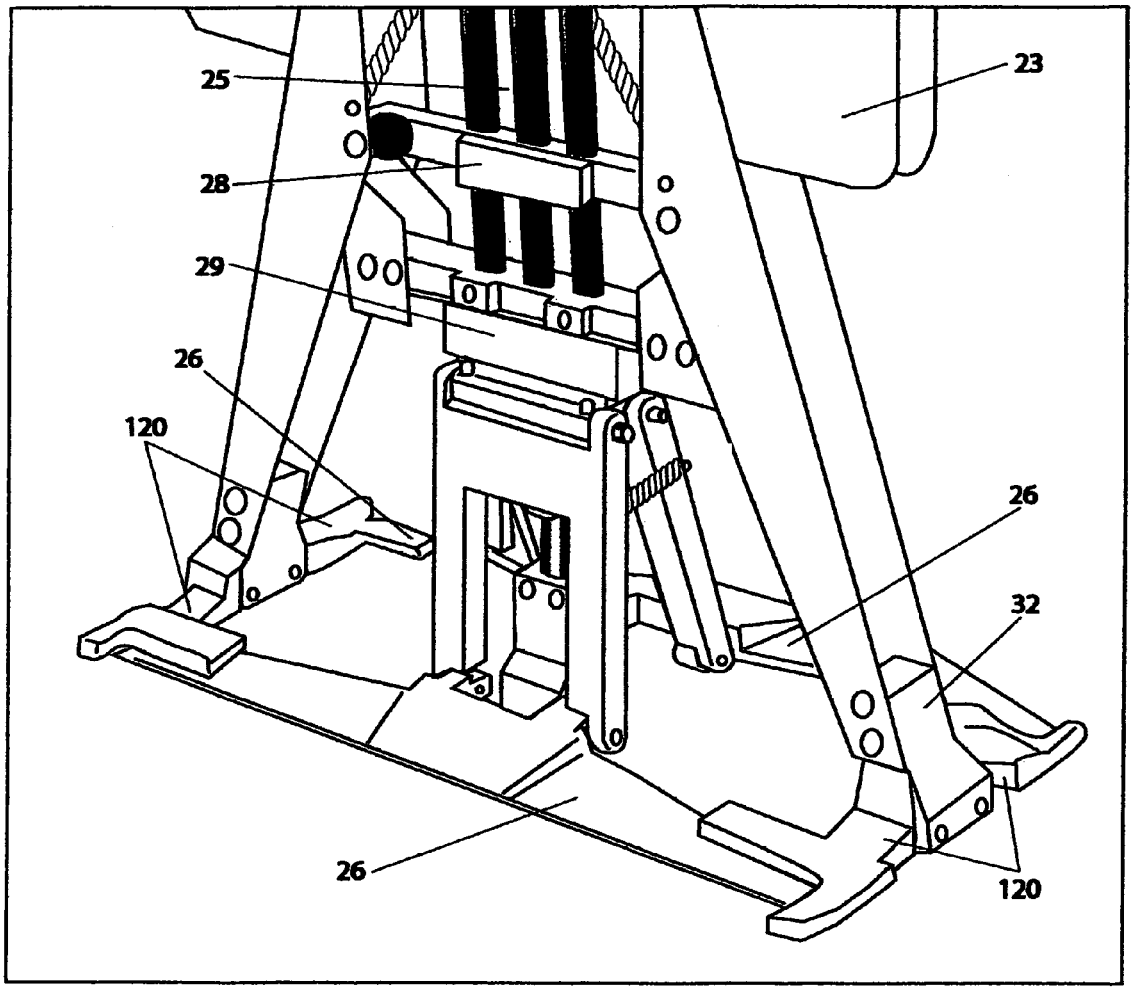
Figure 3F:
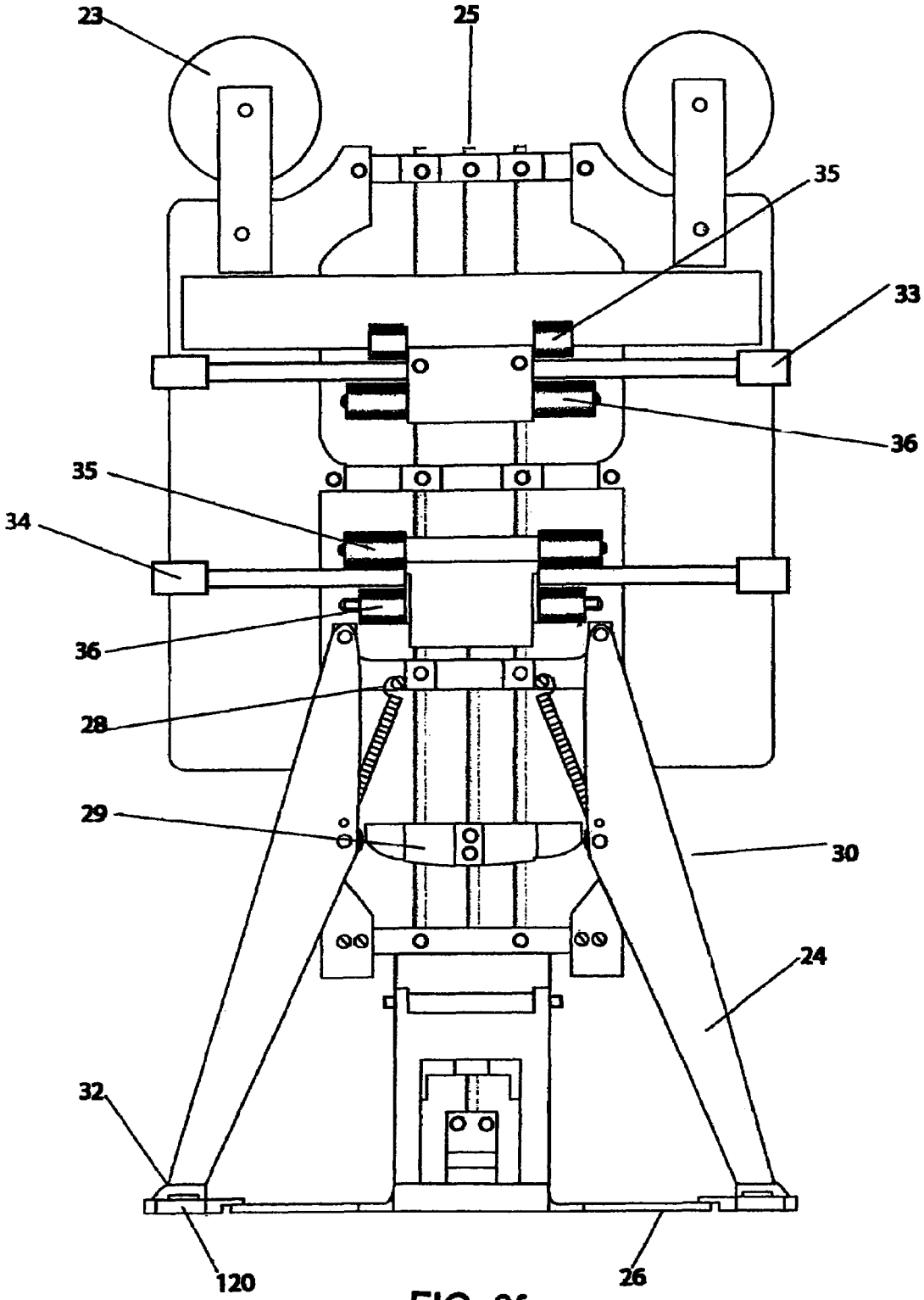

Serving to raise and lower movable section 24 of the mandrel and simultaneous pull or draw down the bag material 19 are an upper roller system, generally depicted by 33 and a lower roller system generally depicted by 34. Each roller set 33 and 34 comprises two pairs of inner rollers 35 and a pair of outer rollers 36 so that the flat sides of the bag material 19 is capable of being threaded therebetween as seen in FIGS. 2 and 3*c* so as to be firmly held for the bag forming process yet being capable of being pulled down through the upper roller set 33 by the lower roller set 34.

Figure 4:
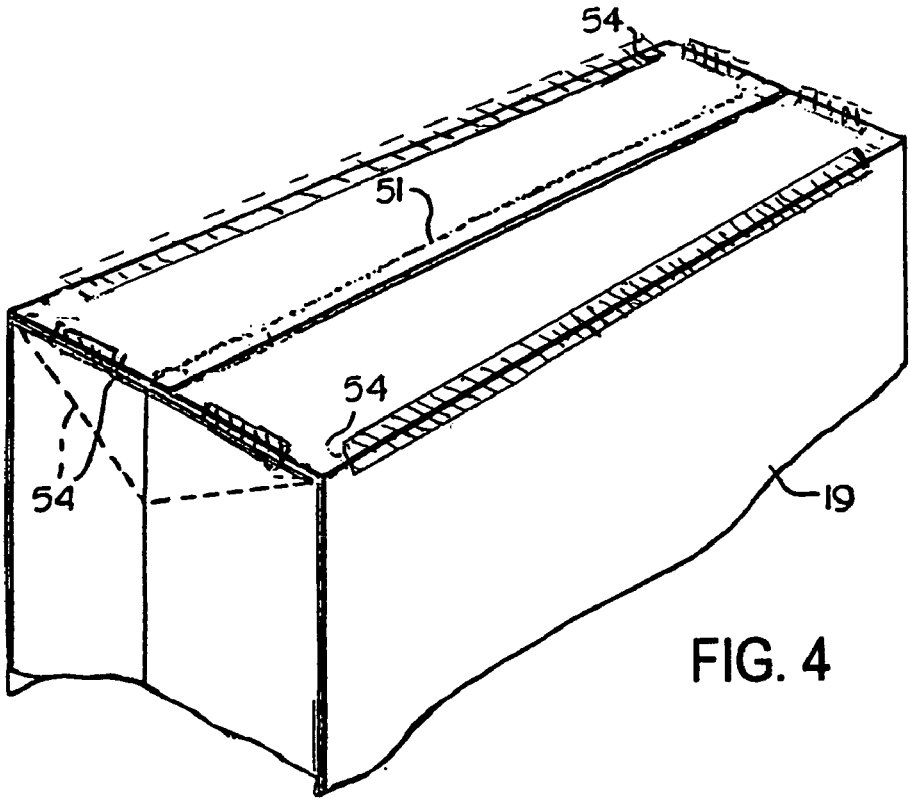
FIGS. 4, 4*a* are views of the bag bottom showing the sealing seams and sealing means thereof.

The lower mandrel 24 consists of two longer plates 26 one of each side and two side plates 120. The two longer plates and the two side plates, one group on each side, have sections cut-out to accommodate the sealers 135 mounted on the bottom platform 130 that allows for the sealing of the face and bottom of the bag on each face and back at the edges as well as sealing the side gusset bottom to the edge of the bottom of the bag as it is joined at this juncture, see 54 in FIG. 4. Therein the bag is sealed at the side edge juncture where the gusset side meets the bottom fabric, rather than the bag bottom, as previous described in said prior related patents.

The upper mandrel 23 incorporates a pair of flat disc guides 27 to accommodate the separate guides mounted on frame 41 generally parallel to the external plane of the bag material 19. These separate external guides can be adjusted so as to keep the bag material 19 and mandrel 24 in place during the manufacturing cycle.

As seen in FIGS. 1 and 2, the roller 35 and 36 of the upper roller set 33 are journalled on a transverse carriage 37 slideably guided over a pair of vertical rods 38 respectively fixed between the base 12 and cross beams 15 on the left and right side of the apparatus. The carriage 37 is fixed at each of its ends on a piston rod 39 actuable by a hydraulic/pneumatic cylinder 40. The transverse carriage 37 is adapted to be raised and lowered by the hydraulic/pneumatic cylinder 40 fixed at one end of the base 12. The piston rod 39 is secured by a bolt 41 to the carriage 37. Although two such piston cylinder arrangements are shown, only one may be really essential and thus used.

The lower roller set 34 is connected to the carriage 37 for relative movement therewith, by a second set of hydraulic/pneumatic cylinders 40 and extending piston rods 43. The piston rods 43 are each fixed to a box journal 44 to which only the outer rollers 36 of the lower roller set 34 are journalled. The inner set of rollers 35 is fixed to the sleeve 28, to be conjointly moveable along the post 25.

It will thus be apparent that the entire lower section of the mandrel assembly 24 including the upper rollers 33 and the lower rollers 34 is movable by actuation of the piston rods 39 while the lower roller section 34 is movable relative to the upper roller section 33 by the independent actuation of the cylinders 42. Operation of the cylinder 40 and 42 in timed cylindrical sequence can be readily effected by known techniques combining suitable connection to a source of hydraulic/pneumatic fluid from the source to the cylinders and in return, as well as timers, relays and the like, to effect the necessary sequence. Such known techniques may be conventionally adopted here.

By lowering the entire mandrel assembly 24, the roller sets 33 and 34 pull down the bag material 19 from the supply roll. The degree of pull-down can be varied by modifying the piston strokes of cylinders 40 and 42, thus the ultimate size of the bag is determined. Further, by separate and independent lowering of the lower roller assembly 34, the sleeve 28 on which the collar 29 is fixed, will cause the hinged arms 30 and plates 32 shown in FIG. 3, to flair outwardly into the horizontal position to thereby open the bag material and initiate the formation of the flat bottom.

Figure 4A:
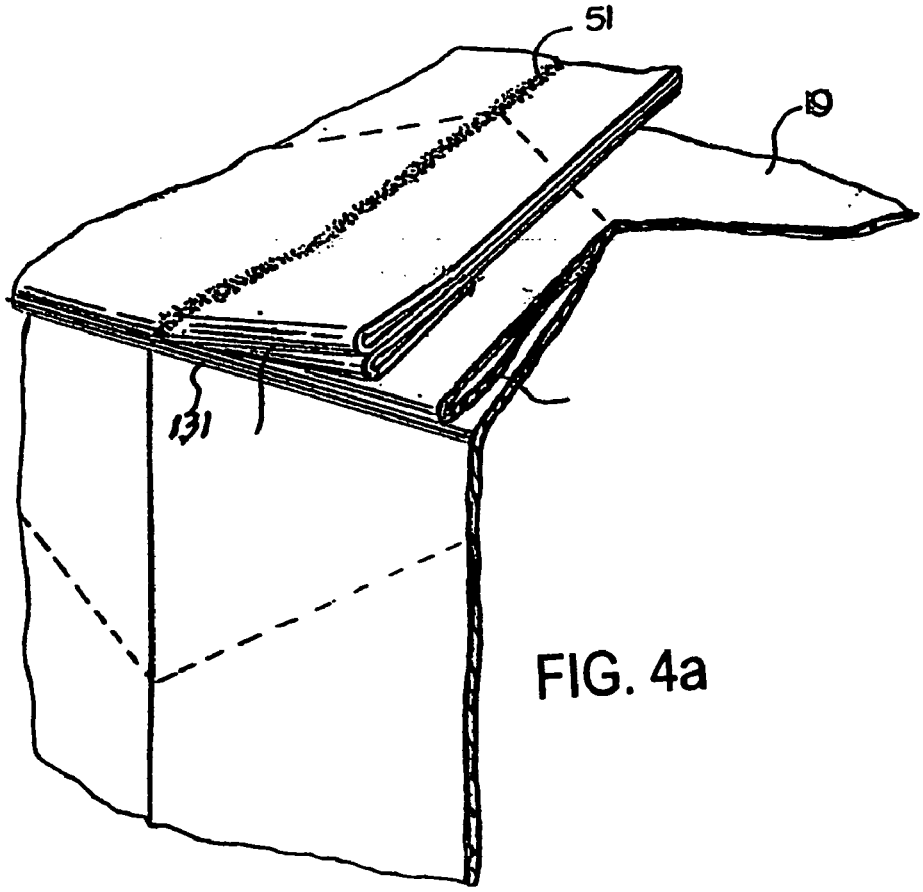

Located at a position below the lower mandrel assembly 24 and above the extreme position wherein the mandrel mechanism may be lowered by actuation of both cylinders 40 and 42 is a heat sealer/cutter mechanism 50. Prior to the flaring of the bag by operation of the cylinders 40 and 42 the mechanism shown in FIG. 3, this sealer/cutter mechanism 50 is caused to be operated to form as seen in FIGS. 4*a* and 4*b*, a transverse seal 51 in the bag material 19 and to cut any preceding excess material or precedingly formed bag from the supply of material. The transverse seal 51 thus closes the bag material 19 just below the plates 26 prior to forming the flat bottom, so that upon further movement of the lower roller assembly 34, the plates 26 push against the closed bottom.

It is this closure of the bag material that, in fact, the cylinders 40 and 42 are sequentially operated. Because the bag is thus sealed, the plates 26 of the movable mandrel section cause the material not only to flare but also to move further downwardly. Spaced below the sealer/cutter assembly 50 by a distance equal to the distance of the ultimate bag height is a platform 130 against which the flared mandrel plates 26 push the closed end of the bag material, producing folded portions 131. Simultaneously, the bottom platform has risen up to meet the sealed open bag where the side sealers and long transverse seals are activated to produce the seals as described in the above paragraphs. The sealing mechanism is hinged and pivots to press against the sealing spaces and is well known in the art and is not described here. In this manner, the bag is completed. Immediately thereafter the completed bag is released at its upper end from the bag material 19 by activation of the sealer/cutter mechanism 50, which has been completed, but simultaneously form the closure seal 51 for the next succeeding bag. The bottom platform 130, mounted on a scissors like mechanism 125, see FIG. 18 returns to the bottom station grasping or pulling the bag and sealing the bag down to the bottom platform original position. The longer transverse and side sealers 135 release their pressure. The mandrel 24 returns to its upward station ready for the operation of cutting, sealing and opening the next bag.

Figure 12:
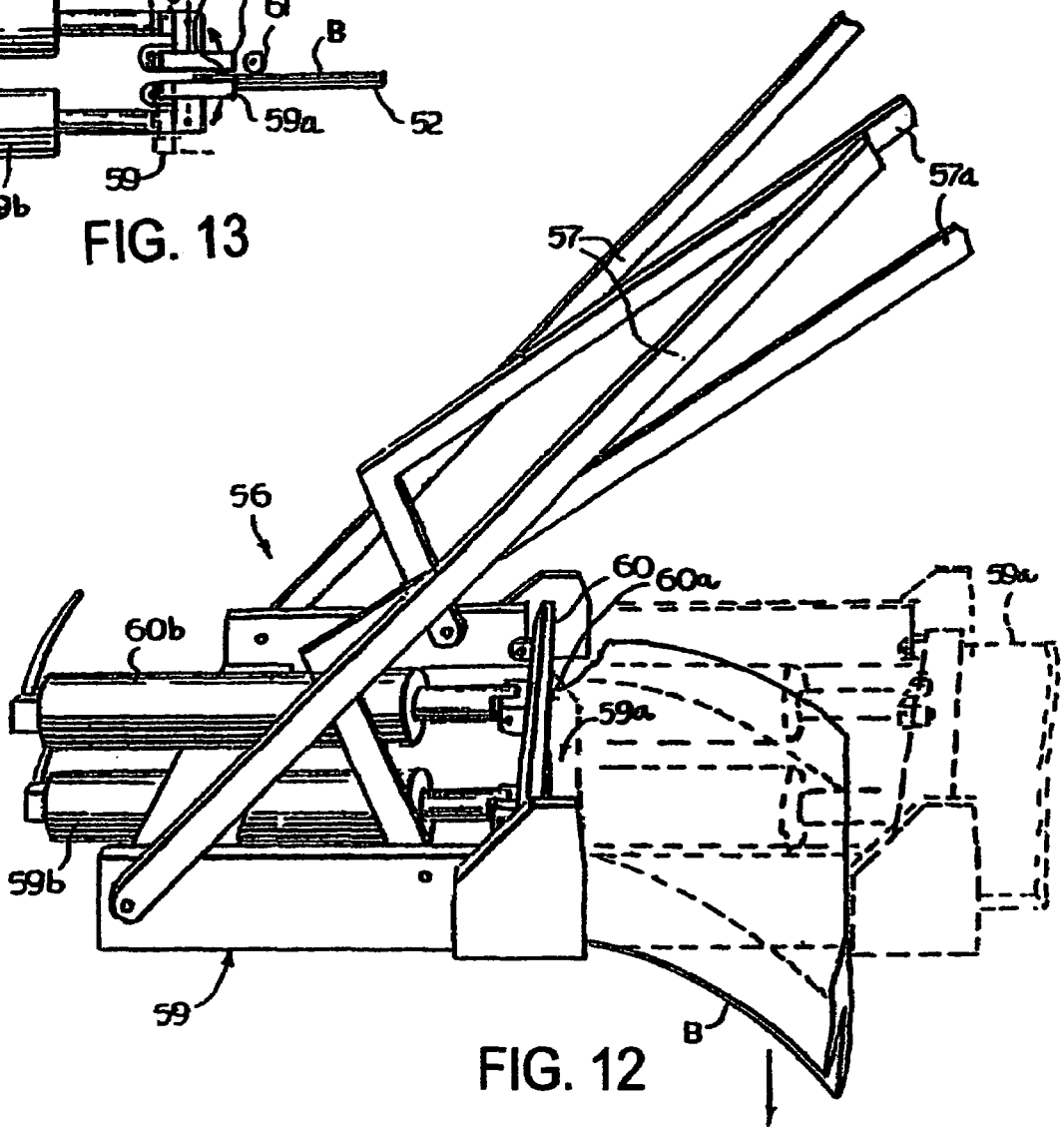

The completed bag is removed from the platform 130 by an ejector assembly generally depicted by numeral, 56 as shown in FIG. 1 and in detail, in FIG. 12 comprising two pair of articulated arms 57 and 57*a* pivoted at the their upper ends 58 to a header beam 16 and depending downward at the rear of the frame. The ejector assembly 115 is provided with a frame 59 having a pivotable bottom plate 59*a* extending forwardly and adapted to enter below the flat bottom bag remaining on platform 130, and an upper plate 60 pivotally mounted on the frame 59 which closes jaw-like over the flat bottom plate 59*a*. The completed bag bottom lying flat against the plate 130 is thereby capable of being grasped between plates 59*a* and 60 which thus flattens due to the action of the plates. Rubber gripping bumpers are located on the upper plate 60 to insure holding of the bag. The plates 59*a* and 60 are pivoted by operation of hydraulic/pneumatic actuators 59*b* and 60*b* respectively. The arms 57 are then swung outwardly from the machine frame carrying with it the bag, which then slides in the direction of the arrow between the plates 130 and a roller 61 FIG. 1 to flatten itself as it is withdrawn. The plates 59*a* and 60 are then opened allowing bag to be stacked one on top of the other on a pallet to the rear of the frame. Because of the arms 57 and 57*a*, the frame 59 remains horizontal during its entire movement.

Figure 11:
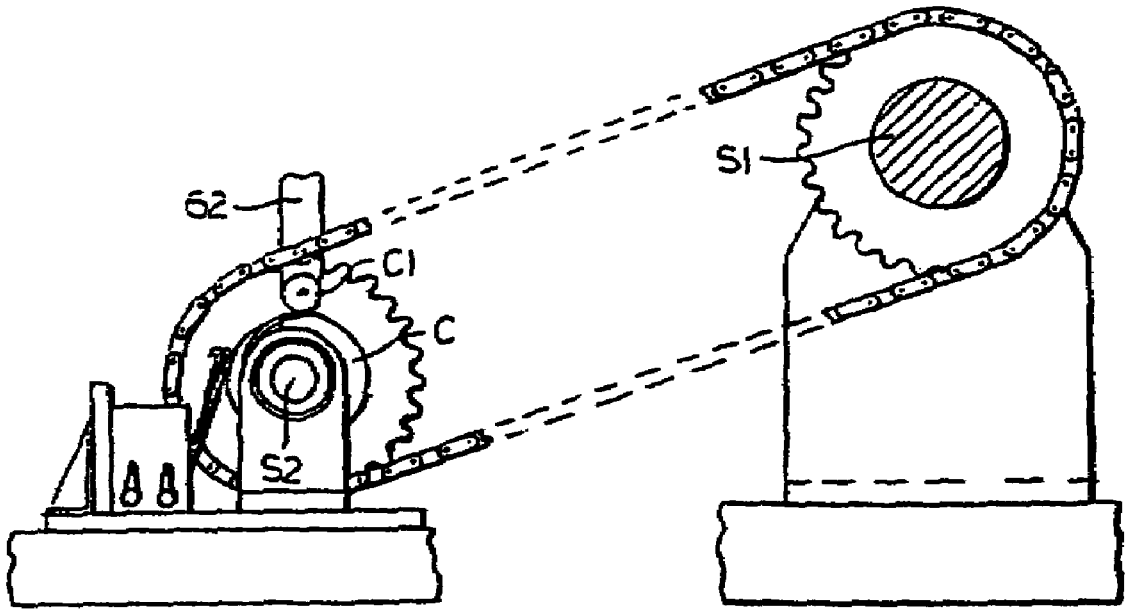
FIG. 11 is a side elevational view of the device and cam transmission used in the present invention.
Figure 13:
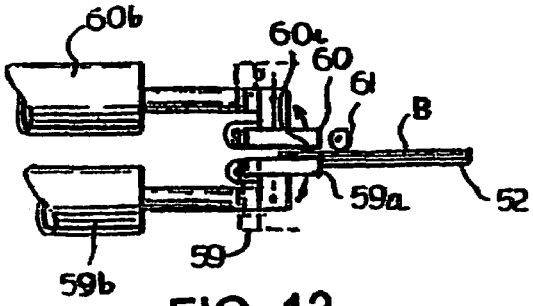
FIGS. 12 and 13 are detailed views of the bag ejector assembly employed to remove the completed bag from the machine.

The ejector assembly is actuated via vertical lever arm 62 extending from the upper end of the ejector arm 57 to the base 12 where it is provided, as seen in FIG. 11, with a cam follower C1 riding on a cam C rotatable by connection to a power transmission shaft S connected to a motor M. The cam C also functions to operate several micro switches capable of regulating the function of the solenoids and valves operating the actuators 59*b* and 60 *b* respectively.

Figure 5:
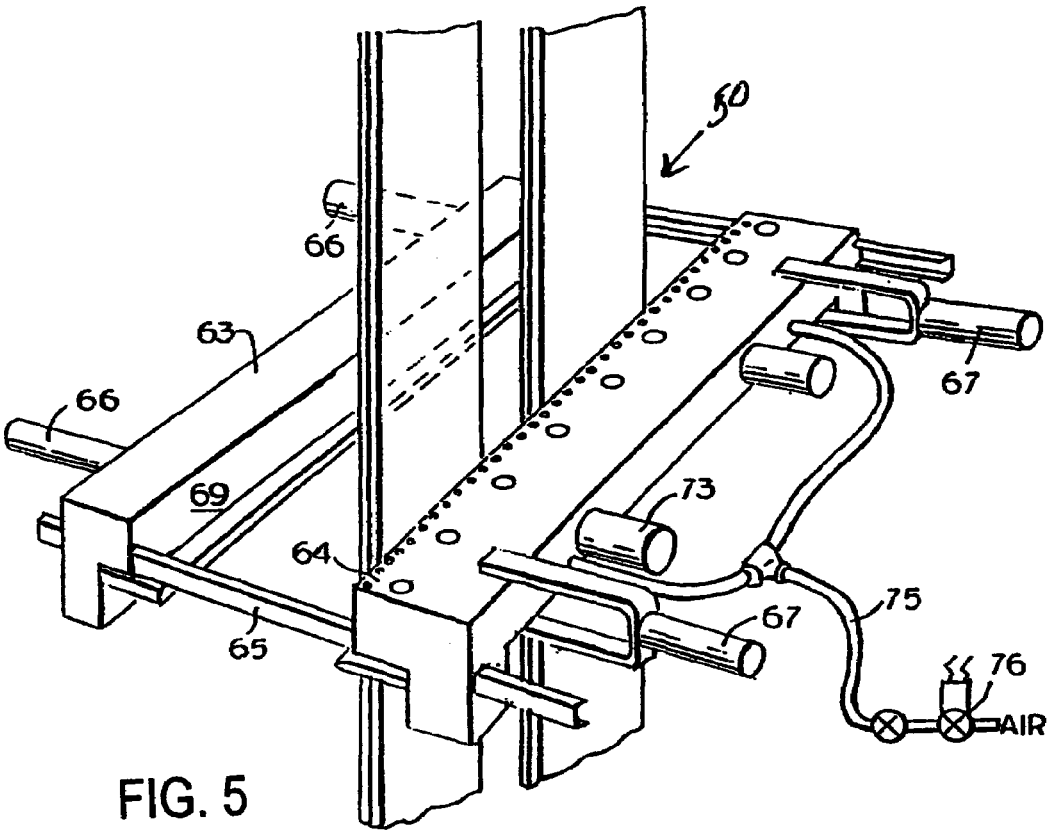
FIG. 5 is a partial perspective view of the details of the bag sealing and cutting mechanism used in the present invention to make a transverse seal.
Figure 6:
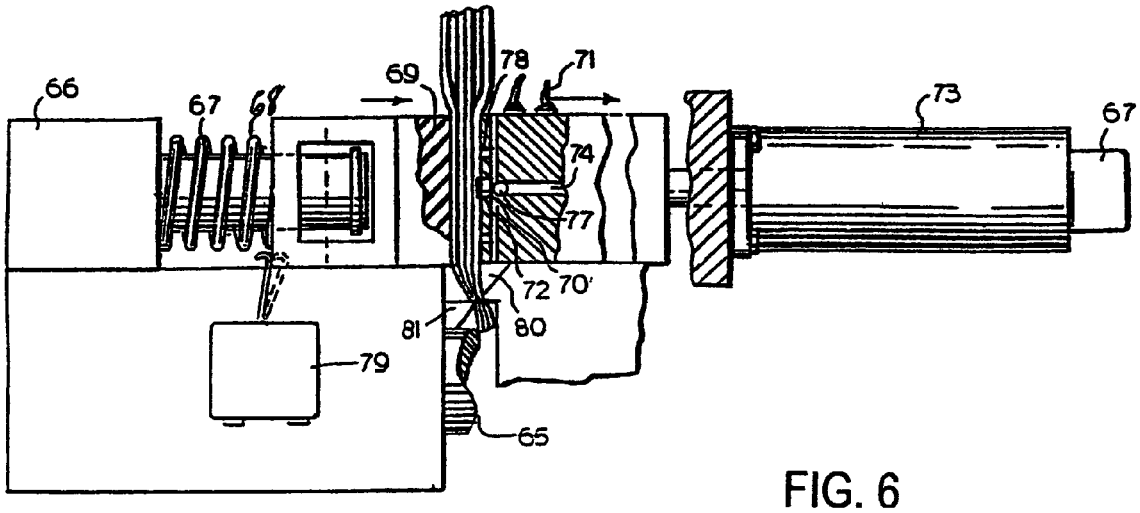
FIG. 6 is a side elevation, partially sectioned of the sealing mechanism shown in FIG. 5.

The heat sealer/cutter mechanism 50 as seen in detail in FIGS. 5 and 6 comprises a back-up assembly 63 and a heater assembly 64. Both of these assemblies are mounted on side support rails 65 (or cylindrical bars) fastened to the machine frame so as to be easily slideable inwardly and outwardly relative to each other on either side of the plane of the bag material 19, see FIGS. 1 and 2. Each of the back-up assembly 63 and heater assembly 64 are actuated by piston cylinder actuators 66 and 67 respectively, the cylinders being fixed to the frame of the housing on opposite sides of the machine frame. Each of the cylinders is provided with a return spring 68, FIG. 6 to insure immediate return of the associated piston upon release of the cylinder actuation. While each of the assemblies 63 and 64 are shown here with two actuators, it will be clear from the later description, that only one may be necessary. Both the back-up assembly 63 and the heater assembly 64 are formed of rectilinear box-like hollow members. The back-up assembly 63 is provided with a hard rubber face 69 to dampen the shock when it meets and abuts the heater assembly 64 and to resiliently squeeze the folded bag material together. The heater assembly 64 contains one or more heating elements 70, FIG. 6 arranged along the length of the face thereof connected in a conventional manner through terminal 71 to a source of electrical current. Preferably the heating elements 70 are mounted on or are constituted by elongated bar 72. In any event, they are reciprocable perpendicularly to the plane of the face so that the elements may be moved into and out of engagement with the faces of the bag material 19, independent of the movement of the back-up member 63 or the heater assembly 64 as a whole. The heater elements 70 or the bar 72 as whole, is moveable by hydraulic/pneumatic piston cylinder actuators 73, the cylinder being mounted on the heater assembly 64 and the piston passing into and through the heater assembly 64.

Passing through the heater assembly 64 from the rear toward the front, are a plurality of air lines 74, FIG. 5 connected by a manifold (not shown) via one or more air lines 75 to a source of air, preferably under pressure, regulated by one or more valves 76, FIG. 5. The air lines 74 communicate with vertical air holes 77, FIG. 6, set back from the face of the heater assembly. The vertical air holes 77 are open at each end to the atmosphere. Small bleeder holes 78 may also be made in the face. Application of air into the heater assembly is made simultaneously with the heating operation, as well as before and after the elements are provided with current. In this manner, the face of the heater assembly is constantly cooled; avoiding overheating, burning of the bag material, sticking of the bag material to the heater assembly, or the rubber back up pad, or burning of the rubber pad itself. As a result, the closing of the bag can be cycled at a very high rate.

The forward thrust of the back-up member and the heater assembly is sensed by a limit switch 79 which also initiates the cycle return of the heater assembly, etc.

Mounted below the forward edge of the heater assembly 64 is a cutter blade 80 having its sharp edge along its lower face. A counter blade 81 is similarly mounted below the forward edge of the back-up member 63. The counter has its sharp edge on its upper face and is adapted to slide below the cutter blade 80. Thus, the bag material can be simultaneously cut and severed from the material roll together with the formation of the bottom seal 51 by action of movement of the back-up and heater assemblies 63 and 64.

Figure 7:
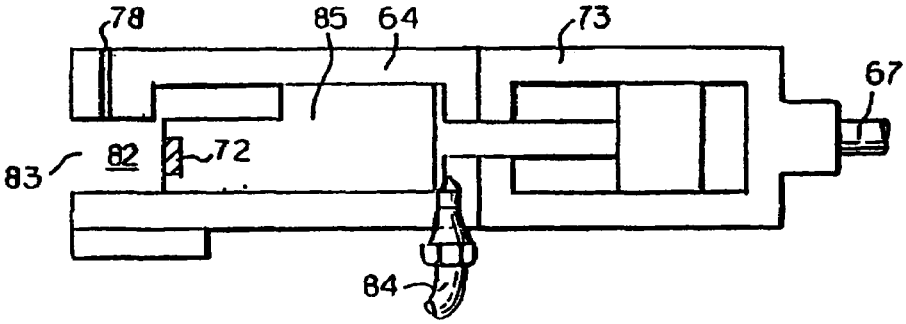
FIG. 7 illustrates schematically, another embodiment of the mechanism.

A modified version of the heater/cutter mechanism 50 is schematically shown in FIG. 7 using the same reference numerals for similarly functioning elements. It is this construction of, the heater assembly 64 comprising of a hollow rectilinear chamber 82 open at its forward face 83 and having vertical bleed holes 78 in its upper wall only. The air is fed via a nozzle 84 directly into the chamber 82. The heater elements 70 are mounted on a solid strip 85, which is actuated by the piston in cylinder 73.

Figure 8:
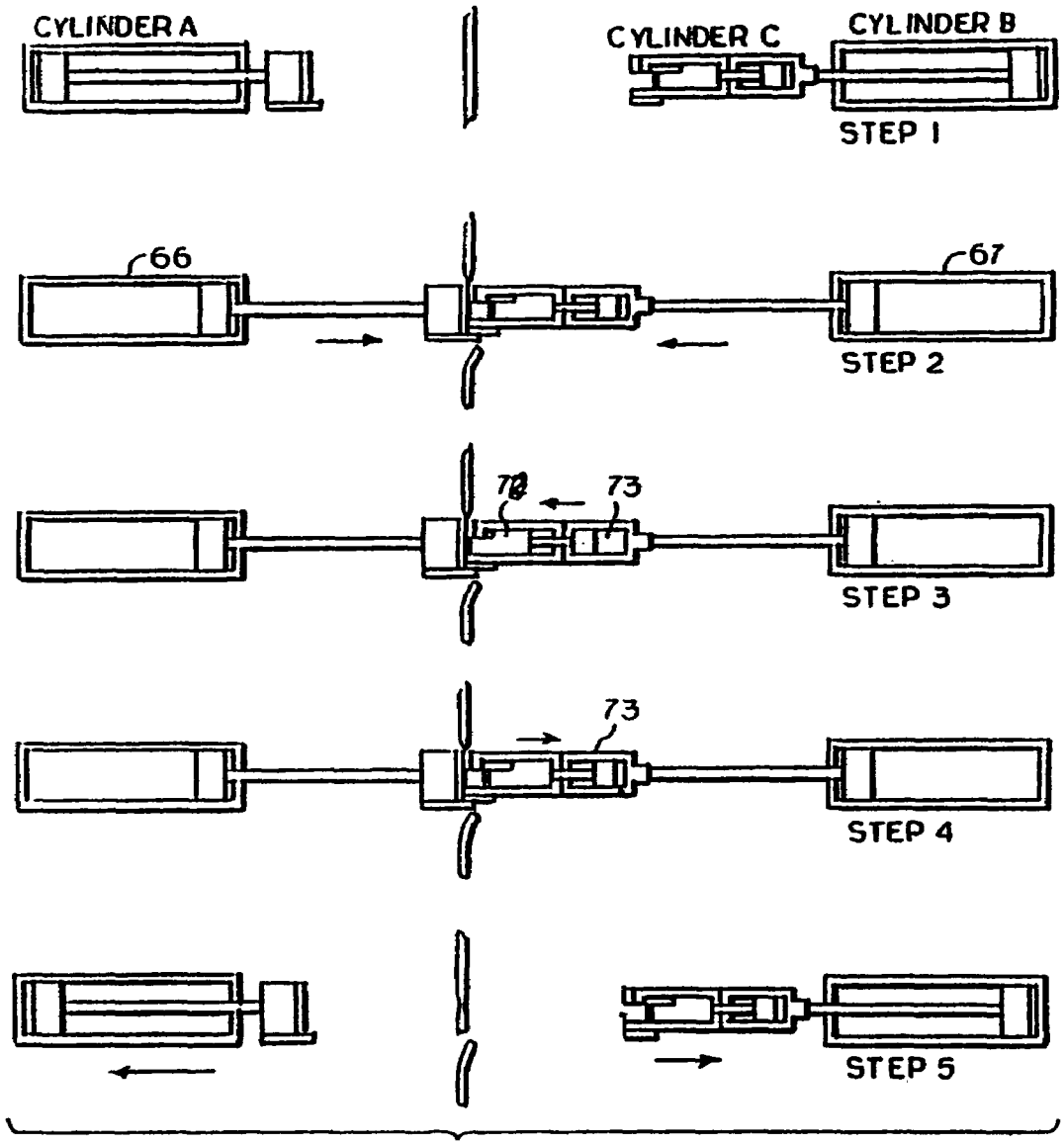
FIG. 8 illustrates the sequence of steps in sealing and cutting the bag.

FIG. 8 illustrates schematically the sequence of five steps necessary to simultaneously heat, seal and sever the completed bag using the embodiment of the heater/cutter mechanism 50. Step 1 shows the position of the back-up member 63 and the heating assembly 64 at rest. In Step 2 the back-up assembly 63 and the heating assembly 64 are moved into abutment by operation of their actuators 66 and 67, thus clamping the bag material firmly therebetween. Thereafter, in Step 3, the actuator 73 is operated causing the heating element 70 to move forwardly and engage the bag material, thus forming the seal. In Step 4, the heating element 70 is withdrawn followed by Step 5 which returns the back-up assembly and heating assembly to the initial rest position, whereupon, simultaneously the bottom platform 130 with its sealing members 135 has risen to meet the open squared-off long transverse sealed bag. The sealing members on the bottom platform are engaged, seal, and grasp the bag pulling it down to the folding station. The art of sealing procedure is previously described by the aforementioned sealing apparatus. The bottom platform returns to its original base 12 position. The sealers 135 are released and the bag folding mechanism FIG. 12 is engaged to fold the bag and make the bag ready for release. At the same time, the mandrel has already returned to its upward position ready to cut and seal and present the next bag for sealing.

Figure 9:
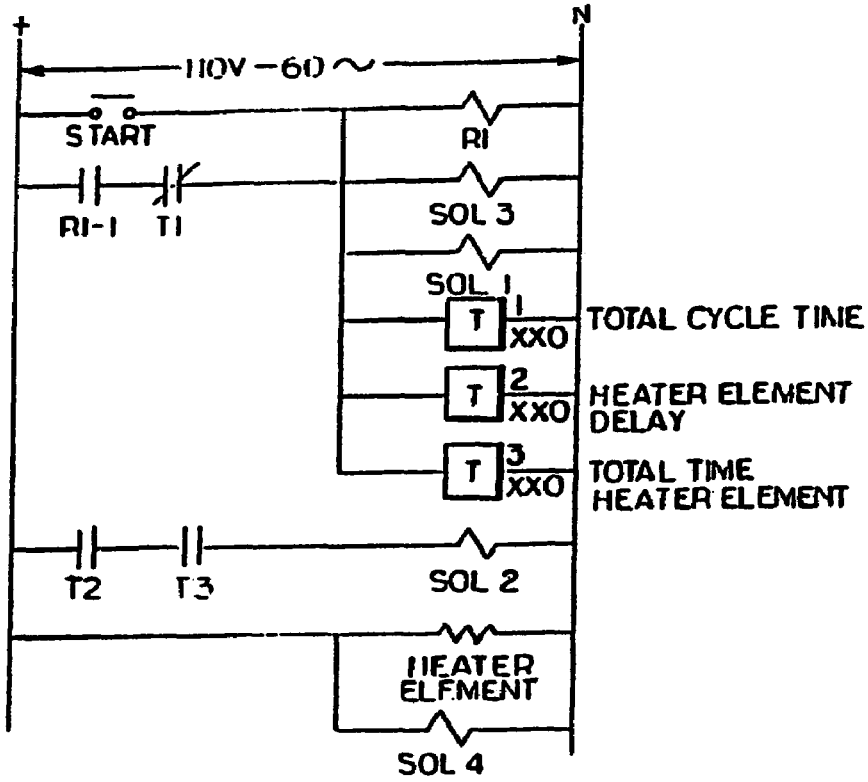
FIGS. 9 and 10 are electrical circuit diagnosis showing the control system for heating and cutting mechanism.
Figure 10:
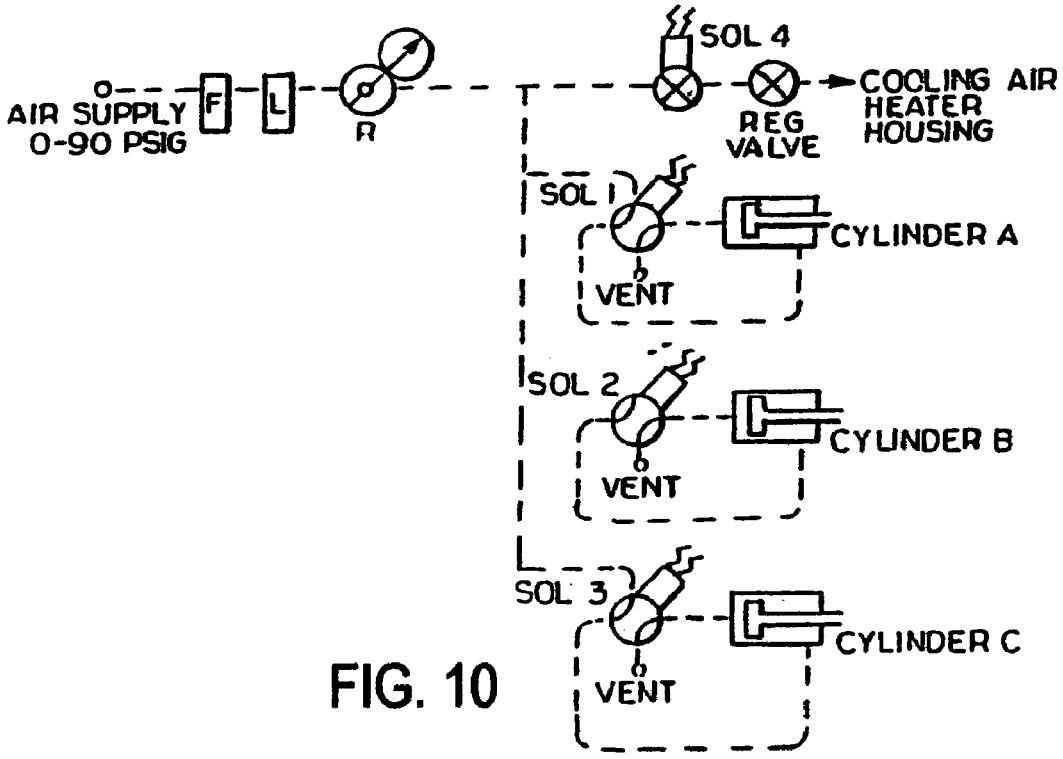

FIGS. 9 and 10 show the electric circuit and hydraulic/pneumatic circuits for accomplishing the steps as shown in FIG. 8. In FIG. 11 the drive motor and belt and cam transmission is illustrated. The cam C and separate micro switches following this cam are arranged so as to provide the pull down cutting and heating as well as the control of the remaining elements of the machine. During operation the position of the heating and sealing assemblies are such that they are spaced from each other, allowing the bag material to be pulled down between them, and flared by operation of the lower forming mandrel 24 which also passes within the back-up and heating assemblies 63 and 64. Once the bag bottom is flattened against the bottom risen platform 130 the side gusset fingers 55 engage the bag and edge clamp means 55*a*, FIG. 2 engage the bag bottom, thus holding the bag firming to allow the lower mandrel 24 with its cut-out plates to be raised. Once the lower mandrel is raised, the heater assembly 135 is free to seal the next bag bottom and sever the bag. In essence, the forming assembly comprising the upper and lower mandrels is actuated to create the succeeding bag.

The high speed at which the heater apparatus works and the fact that the air flows over the heating strip negates the requirement to use Teflon covers or other cover means for the back-up assembly. Both the back up and the heater assembly move toward the center. The bag material is immediately cut by the cutting blades and held and gripped generally between the two assemblies. When the heating element brought into contact with the gussetted bag material by the extension of the cylinder, this contact is a very short duration, and with the pressure of the cooling air on deactivation of the cylinder, the sealing element is easily withdrawn from the bag material and does not stick to it.

Figure 14:
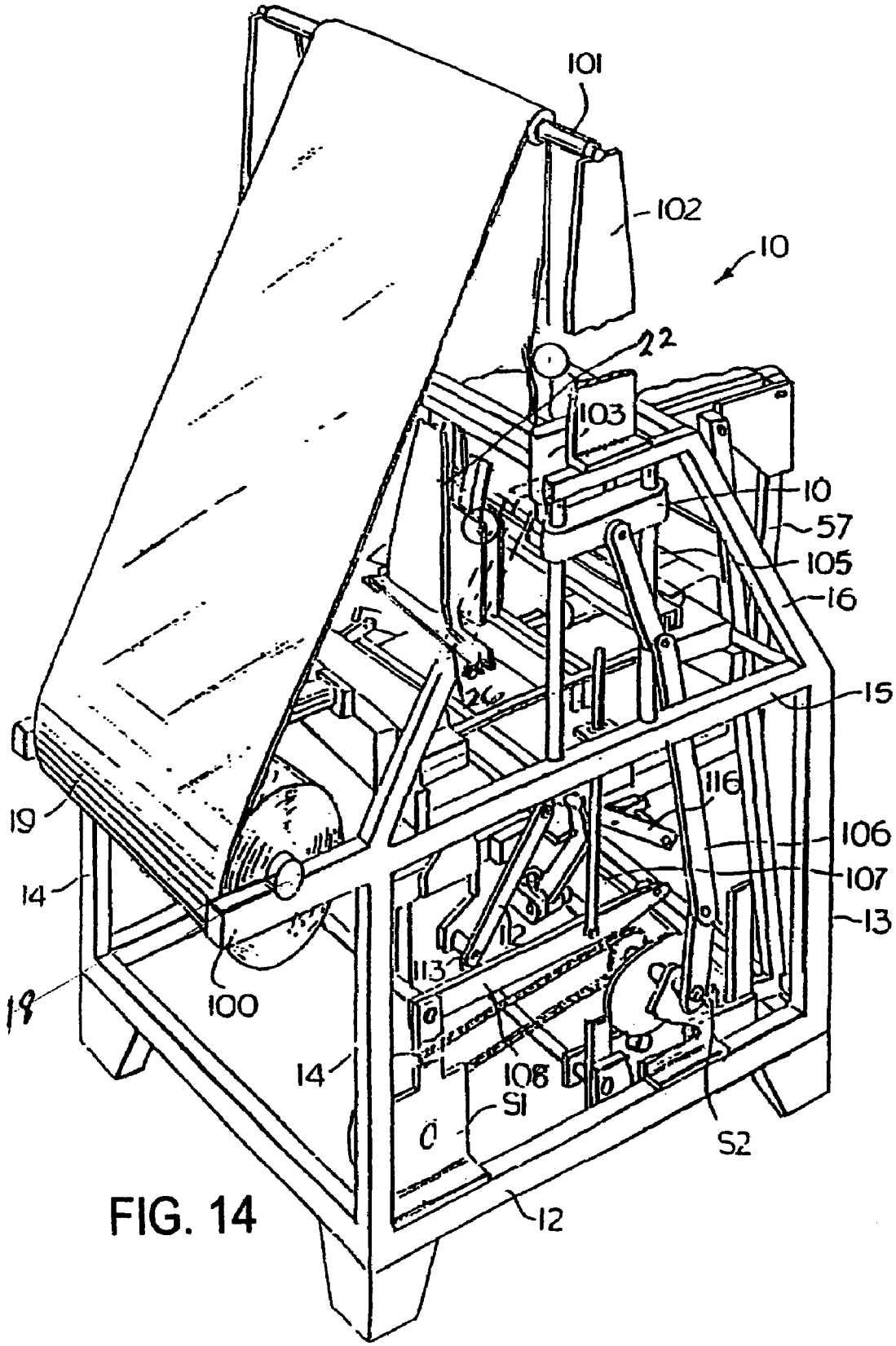
FIG. 14 is a view similar to FIG. 1 showing a modified version of the bag forming apparatus.
Figure 17:
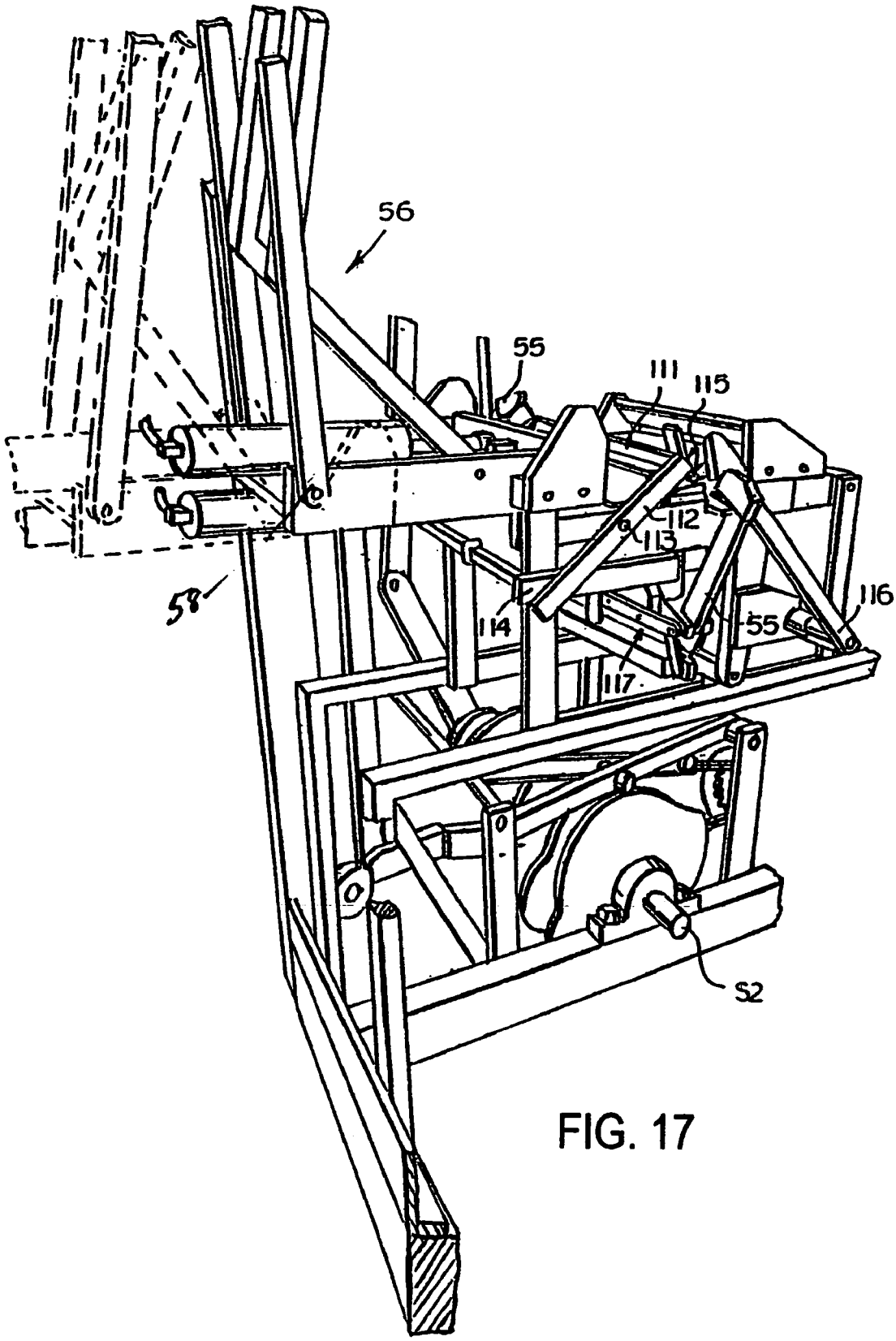
FIG. 17 is an enlarged view of the lower portion of the apparatus of FIG. 14.

In the modified apparatus shown in FIGS. 14 and 17, like elements are depicted with the same numerals as heretofore and unless specified, function in the same way.

Differing from the earlier version, in that of FIG. 14, the bag material 19 supply roll is mounted on a roller 18 journalled at each end in a rearwardly extending bracket arm 100, integral with the cross bars 15. This permits easier loading of new bag material rolls. The headers 16 extend pyramidally upward and the bag material 19 passes over and idler roller 101 journalled on a vertical standard 102 integrally fix to the headers 16. The material passes downwardly over the bag forming apparatus 22, which in general, comprises the upper and lower mandrel assemblies 23 and 24 as described earlier. Here, however, the roller sets 33 and 34 are mounted on associated carriage blocks 103 and 104 respectively, on each of the lateral sides of the machine. The lower blocks 104 holding roller sets 34 slides reciprocally on a pair of vertical rods 105 and is actuated to move upwardly and downwardly through the articulated linkage 106 connected to the cam shaft mounted on base 12, being the cam shaft shown in FIG. 11.

Figure 15:
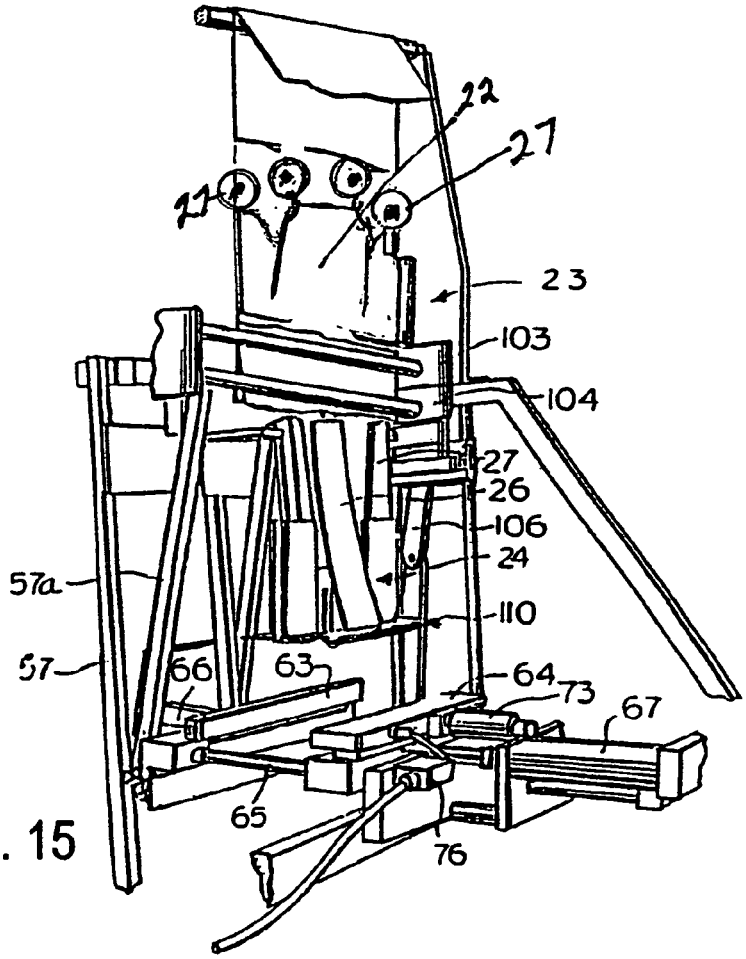
FIG. 15 is a vertical perspective of the bag forming assemblies and heater-cutter mechanism employed in the apparatus of FIG. 14.
Figure 16:
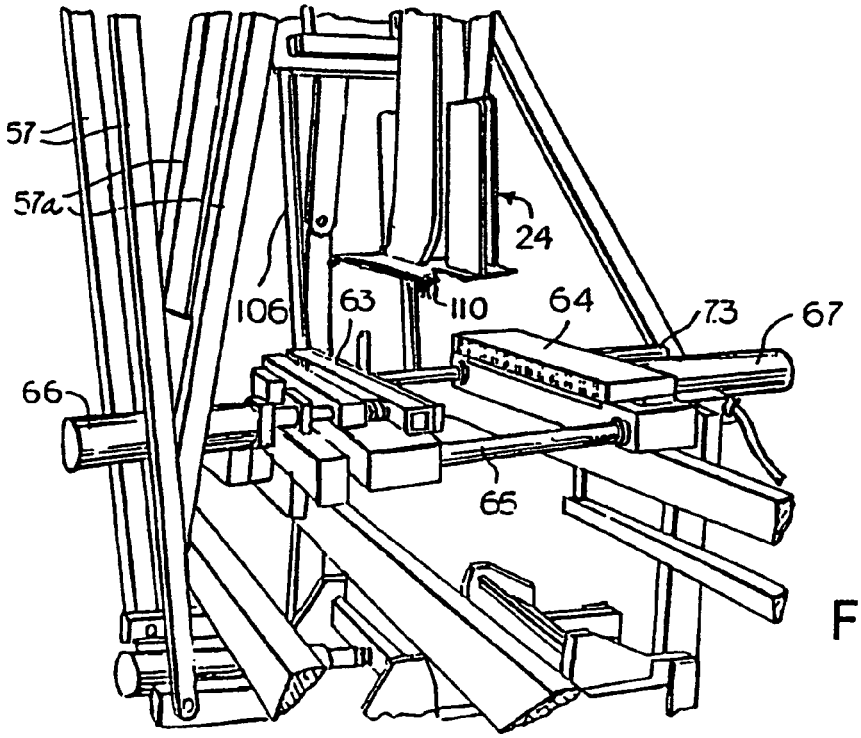
FIG. 16 is an enlarged view downwardly into the apparatus showing the detail of FIG. 15.

The upper carriage block 103 carrying the roller set 33 rests on the lower carriage block 104, but is slightly offset inwardly therefrom. In this manner, movement of the lower carriage block 104 conjointly moves the upper carriage block 103. The necessary relative movement between the two roller sets 33 and 34, required to permit the lower mandrel to move the bag material down, is effected by providing a vertical post 107 beneath the upper carriage block 103. The post 107 is mounted on an adjustable arm 108 so that the upper end 109 of the post 107 can be located and given height to arrest the downward movement of the upper carriage block 103 to meet the upward traveling bottom platform station 12. Then, adjustable arm 108 will rotate and cause bottom platform to return to its original position. Another difference seen in FIG. 14 as well as in FIGS. 15 and 16, is the flaring plate of the lower mandrel assembly, which is shown here as an elongated member 110.

Figure 18:
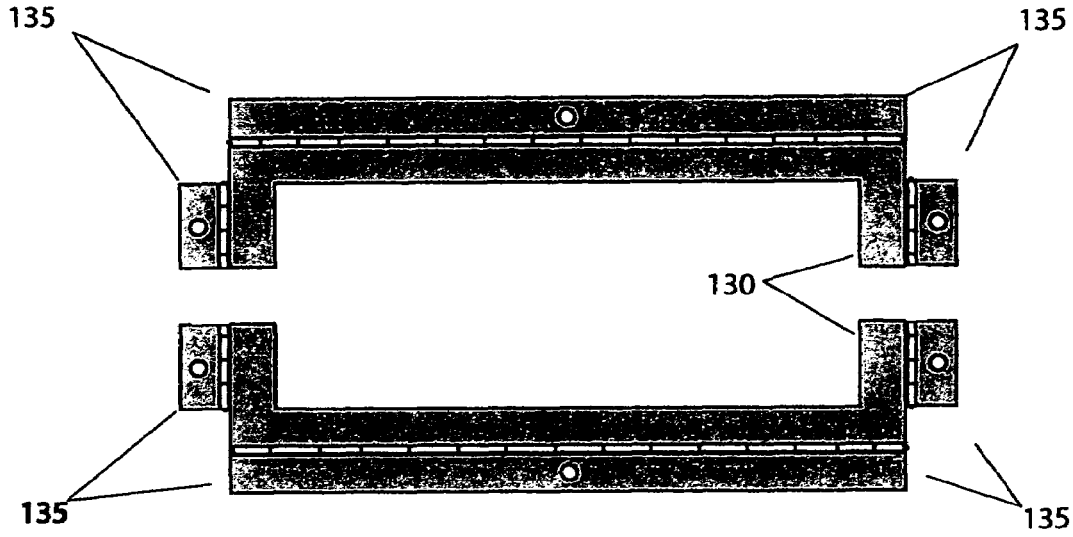
FIG. 18 a view of the bottom platform with scissors method of operation to draw the bag down to the folding station along with notation of the sealing sections.
Figure 18:
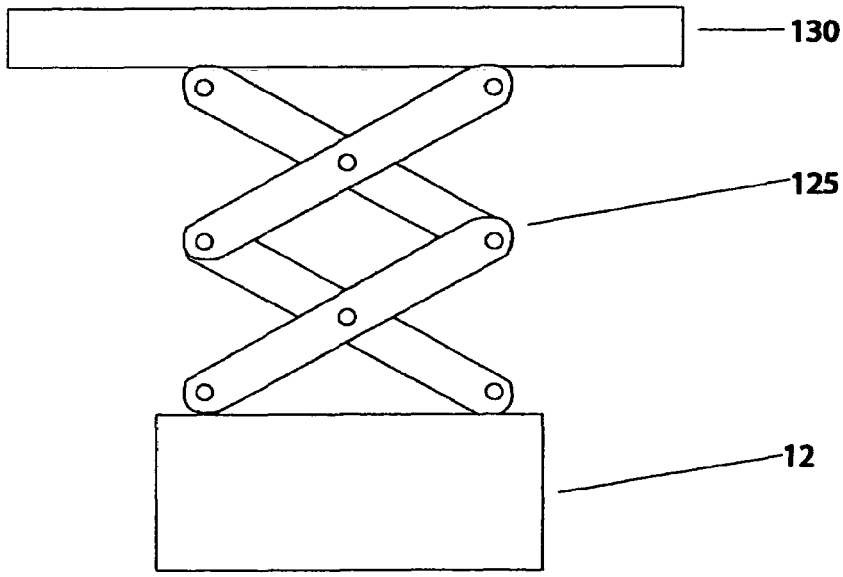
Figure 19:
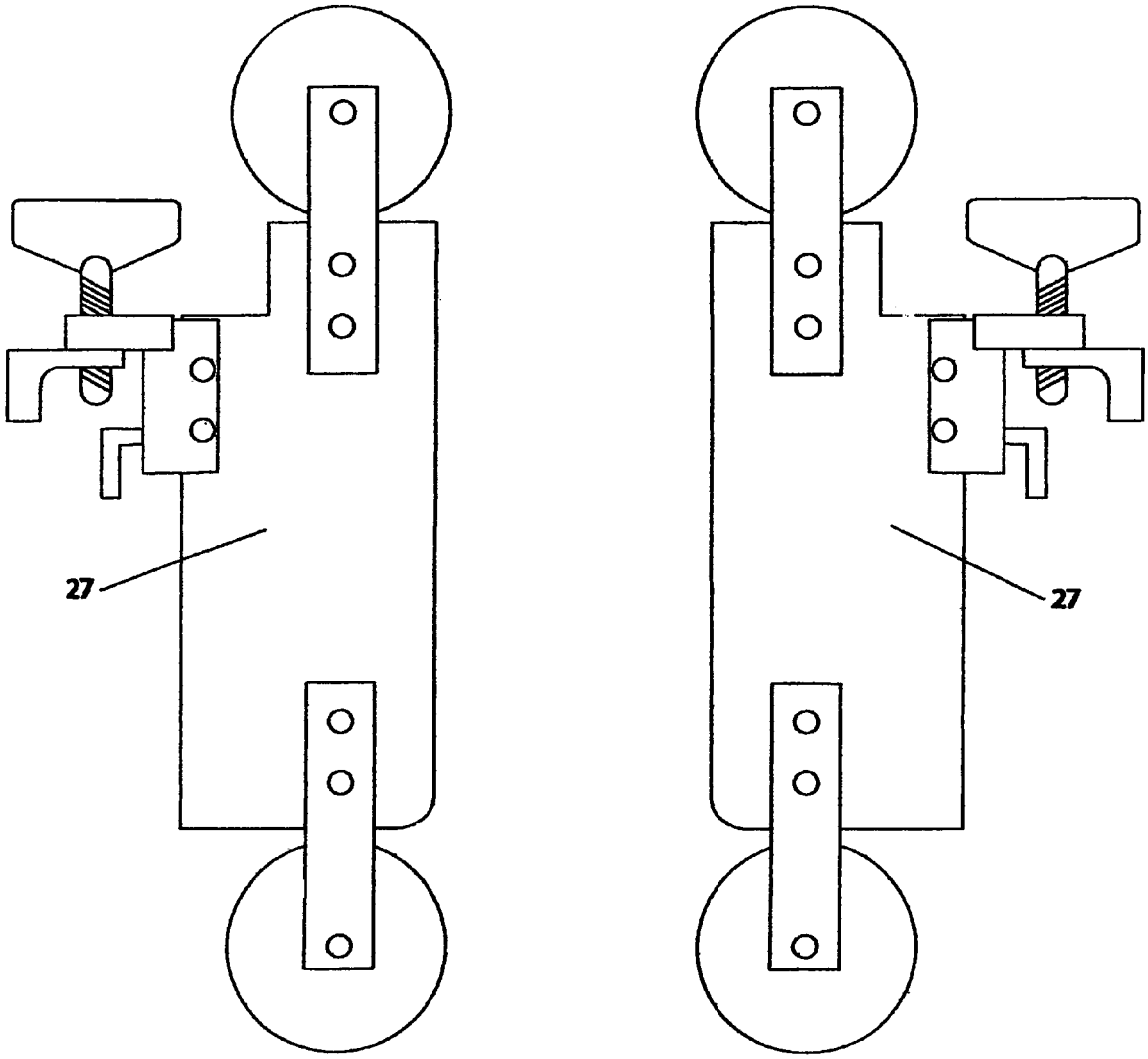
FIG. 19 a view of mandrel gusset side guides.

Turning to FIG. 17, additional detail is shown with regard to the platform 130, see FIG. 18, and the clamping members for holding the bag in place, allowing the lower mandrel assembly to be raised before the bottom platform lowers the bag to the ejector assembly 115 removing the bag. Here, a transversely extending arm 111 fixed at each end to a pivoted arm 112, is mounted on the side of the platform 130 adjacent to the ejector assembly 115. The arm 112 is pivoted at its center 113 and fixed to a horizontal strip 114 which is connected to a vertical rod riding on a cam connected to the drive cam C described earlier so that as the horizontal strip 114 is raised and lowered, arm 112 is swung toward or away from the platform 130. The rod 111 is thus caused to clamp and release the bag bottom to the platform, functioning as the clamp 55*a* shown in FIG. 2, which it can easily replace, if desired. On the opposite side of the platform, there is similarly mounted an elongated transverse roller 115 on a pair of end arms 116 articulately connected to follow another cam connected to the drive cam, in a conventional manner. The clamp arm 111 is held against the bag until such time as the ejector assembly 115 grasps the bag as previously described and pulls the bag causing the bag to fall on to platform 130 being pulled beneath the clamp arm 111. Once this occurs, the arm 111 raises slightly and the roller 115 is caused to swing onto the fallen bag exerting sufficient roller pressure to flatten the entire bag, as it is being pulled. Once the bag is removed from the platform 130, the arm 111 and roller 115 are withdrawn, preparing the platform for receipt of the next bag in the cycle.

As seen also in FIG. 17, the gusset fingers 55 are articulately connected to a scissors-like linkage 117 operated also by connection to cam so that it will, in the necessary timed sequence of operation, cause the tucking inward of the gusset and its hold-down prior to removal of the lower mandrel 24.

Each of these modifications and elements shown in FIGS. 14-17 could be equally adopted and used in the embodiment of FIGS. 1-13 replacing or augmenting the similarly functioning elements.

Various modifications, changes, and embodiments have been disclosed, and others will be apparent to those skilled in the art. Accordingly, it is intended that the disclosure be taken as illustrative and not limiting of the scope of the invention.

What is claimed is:

1. An improved machine for making a bag having a front face with a lower edge, a back face with a lower edge, a bottom with peripheral edges, and a pair of gusset sides with lower edges, and being of the type having a frame, an upper mandrel, a lower mandrel with an upper position and a lower position, and sealers, said improvement comprising:

the lower mandrel having a pair of long plates and a pair of short side plates; each of the two long plates of the lower mandrel has a cut-out section and each of the two short side plates of the lower mandrel has a pair of cut-out sections; said cut-out section of each of the two long plates of the lower mandrel selectively accommodate the sealers when the lower mandrel is in the lower position thereof allowing sealing of the lower edge of the front face of the bag with an associated peripheral edge of the bottom of the bag and the lower edge of the back face of the bag with an associated peripheral edge of the bottom of the bag; said pair of cut-out sections in each of the two short side plates of the lower mandrel selectively accommodate the sealers when the lower mandrel is in the lower position thereof allowing sealing the lower edges of the pair of gusset sides of the bag with a pair of associated peripheral edges of the bottom of the bag so as to allow the bag to be sealed where the gusset sides of the bag meet associated peripheral edges of the bottom of the bag instead of the bottom of the bag proper.

2. The improvement of claim 1, wherein said improvement further comprises a bottom platform; the sealers are mounted on said bottom platform and selectively are received in said cut-out in each of the two long plates of the lower mandrel and said pair of cut-outs in each of the two short side plates of the lower mandrel when the lower mandrel is in the lower position thereof.

3. The improvement of claim 1, wherein said improvement further comprises:

a) a pair of first flat disc guides; and b) a pair of second flat disc guides separate from said pair of first flat disc guides;

wherein said first pair of flat disc guides are incorporated in the upper mandrel and accommodate said pair of second flat disc guides that are mounted on the frame generally parallel to and external of the bag.

4. The improvement of claim 3, wherein said improvement further comprises said pair of second flat disc guides being adjustable to keep the bag and the upper mandrel in place during manufacturing.

5. The improvement of claim 1, wherein said improvement further comprises said bottom platform movable to and away from the lower mandrel from an upper position to a lower position so as to allow said bottom platform with the sealers to rise to the upper position of said bottom platform to meet the lower mandrel in the lower position thereof containing the bag where the sealers on said bottom platform engage, seal, grasp, and pull the bag down, while the lower mandrel rises to the upper position thereof, to the lower position of said bottom platform where the sealers are ultimately released.

* * * * *